US005339089A

United States Patent [19]

Dienes

[11] Patent Number: 5,339,089

[45] Date of Patent: Aug. 16, 1994

[54] ANTENNA STRUCTURE

[75] Inventor: Geza Dienes, Claremont, Calif.

[73] Assignee: Andrew Corporation, Orland Park, Ill.

[21] Appl. No.: 42,497

[22] Filed: Apr. 2, 1993

Related U.S. Application Data

[63] Continuation-in-part of Ser. No. 618,152, Nov. 23, 1990, abandoned.

[51] Int. Cl.[5] ..... H01Q 1/38

[52] U.S. Cl. ..... 343/700 MS; 343/872

[58] Field of Search ..... 343/700 MS, 872, 789, 343/790, 791, 792, 827, 828; H01Q 7/38, 9/04, 9/30, 9/32

[56] References Cited

U.S. PATENT DOCUMENTS

| | | | |
|---|---|---|---|
| 2,750,589 | 6/1956 | Harris | 343/827 |
| 2,785,399 | 3/1957 | Harris | 343/796 |
| 3,757,342 | 9/1973 | Jasik et al. | 343/738 |
| 3,781,894 | 12/1973 | Ancona et al. | 343/706 |
| 4,031,537 | 6/1977 | Alford | 343/704 |
| 4,287,518 | 9/1981 | Ellis, Jr. | 343/700 |

FOREIGN PATENT DOCUMENTS

| | | | |
|---|---|---|---|
| 2632772 | 1/1978 | Fed. Rep. of Germany . | |
| 51-132058 | 11/1976 | Japan . | |
| 54-37663 | 3/1979 | Japan . | |
| 0097901 | 6/1983 | Japan | 343/700 MS |
| 2142475 | 1/1985 | United Kingdom . | |
| 2142782A | 1/1985 | United Kingdom . | |

*Primary Examiner*—Donald Hajec
*Assistant Examiner*—Tan Ho
*Attorney, Agent, or Firm*—Arnold, White & Durkee

[57] ABSTRACT

An improved radio frequency antenna may be manufactured and assembled in a cost-effective manner using a pair of conductive sections. A first conductive section has alternating trough and narrow portions, and an opposing second conductive section has alternating trough and narrow portions which are arranged opposite the narrow and trough portions, respectively, of the first conductive section. Each trough portion partially surrounds its opposing narrow portion. The first and second conductive sections are secured together with a gap formed therebetween such that the first and second conductive sections form an elongated unit having a first end and a second end. Each end of the unit may be terminated with a short, an open or a load between the first and second conductive sections, and a coaxial cable may be electrically coupled to the first and second conductive sections at a selected point along the length of the unit for coupling a radio frequency signal to the antenna. Alternatively, the unit may be terminated at only one end, and the other end of the unit may be used for interfacing to the coaxial cable. Further, a smaller diameter radome may be used to enclose the unit because of the compactness of the improved trough line antenna structure.

22 Claims, 8 Drawing Sheets

ANTENNA STRUCTURE

CROSS-REFERENCE TO RELATED APPLICATION

This application is a continuation-in-part of U.S. application Ser. No. 07/618,152, filed Nov. 23, 1990, entitled "Improved Antenna Structure," now abandoned.

BACKGROUND OF THE INVENTION

The present invention relates generally to antennas for radio frequency communication and, more particularly, to polarized antennas for radio communication in frequency ranges above about 100 MHz.

DESCRIPTION OF THE RELATED ART

Accurate and cost-effective radio signal transmission is becoming increasingly important in many applications. For example, widespread use of cellular radio communication has significantly raised the stakes in terms of service and sales. Proper antenna design can provide tangible benefits with respect to communication performance and equipment maintenance. These benefits include savings in terms of maintenance costs, equipment utilization, and increased system reliability. Moreover, cost-effective antenna designs provide reduced manufacturing costs and increased sales and profits.

While numerous antenna structures have been designed with the above objectives in mind, each has compromised cost and/or performance. One of the most popular structures, for example, is a sleeved-dipole assembly, which includes a collinear array of dipoles secured to and surrounding a coaxial cable. The dipoles are used to convert the coaxial cable into a radiating transmission line, or antenna. Unfortunately, this type of antenna system is costly to manufacture and maintain due to the number of dipoles and related mounting components.

Accordingly, there is need for an antenna structure which overcomes these deficiencies.

SUMMARY OF THE INVENTION

A general object of the present invention is to provide an improved antenna structure that is reliable, accurate and cost-effective to manufacture and sell.

Another object of the present invention is to provide an improved antenna structure that produces a more omnidirectional azimuth pattern.

A further object of the present invention is to provide an improved antenna structure with an improved array pattern.

Still another object of the present invention is to provide a more compact antenna structure capable of fitting into a smaller diameter radome.

A still further object of the present invention is to provide an improved antenna structure such that the impedance of the radiating elements is easily controlled.

A more specific object of the present invention is to provide an improved antenna structure that may be manufactured using a pair of opposing sheets of conductive material, which may be punched or etched from a single piece of sheet metal.

These and other objects of the present invention are realized using a first conductive section having alternating wide and narrow portions, and a complementary opposing second conductive section having alternating wide and narrow portions which are arranged opposite the narrow and wide portions, respectively, of the first conductive section. The wide elements of the first and second conductive sections are bent into U-shaped troughs so that the three sides of a trough surround the narrow portion of the opposing conductive section. The narrow segments are longer than the trough segments to insure no contact between successive troughs. The outer surface of the troughs emit desirable radiation while suppressing the undesirable radiation emitted from the narrow portions of the conductive sections. The narrow segments and the inner surface of the troughs form a transmission line. The troughs improve the array pattern for the antenna because the troughs reduce the unwanted radiation from the narrow segments. The azimuth pattern of the antenna becomes more omnidirectional because the folding of the wide elements to form the troughs reduces the azimuth aperture or cross-section of the antenna. In addition, the impedance of the trough line radiating elements are easily controlled because the troughs suppress the deleterious radiation from the narrow segments. Thus, the trough line impedance is easily adjusted by simply changing the width of the narrow segments or "center conductor" without affecting the antenna's array pattern.

The first and second conductive sections are secured together such that a gap exists between them. In this way, the first and second conductive sections form an elongated trough line having a first end and a second end. The gap is not necessarily uniform throughout the length of the trough line. A coaxial cable is electrically coupled to the first and second conductive sections for coupling a radio frequency (RF) signal to the antenna. In one embodiment, a short, open or load terminates at least one end of the unit, and a radome is used to enclose the unit. The trough line antenna fits into a smaller diameter radome because the troughs bend around the narrow segments of the opposing conductive section to provide a compact structure having shall cross-sectional dimensions.

Preferably, the unit is terminated by a conductor, an open or a load at only one end, and the other end of the unit is used for interfacing to the coaxial cable.

In another preferred embodiment, the unit is shorted, opened or loaded at both ends, and a coaxial cable is electrically coupled to the first and second conductive sections at a selected point along the length of the trough line for coupling the radio frequency signal to the antenna and achieving a desired pattern response.

BRIEF DESCRIPTION OF THE DRAWINGS

Other objects and advantages of the invention will become apparent upon reading the following detailed description and upon reference to the drawings in which.

Figure 1:
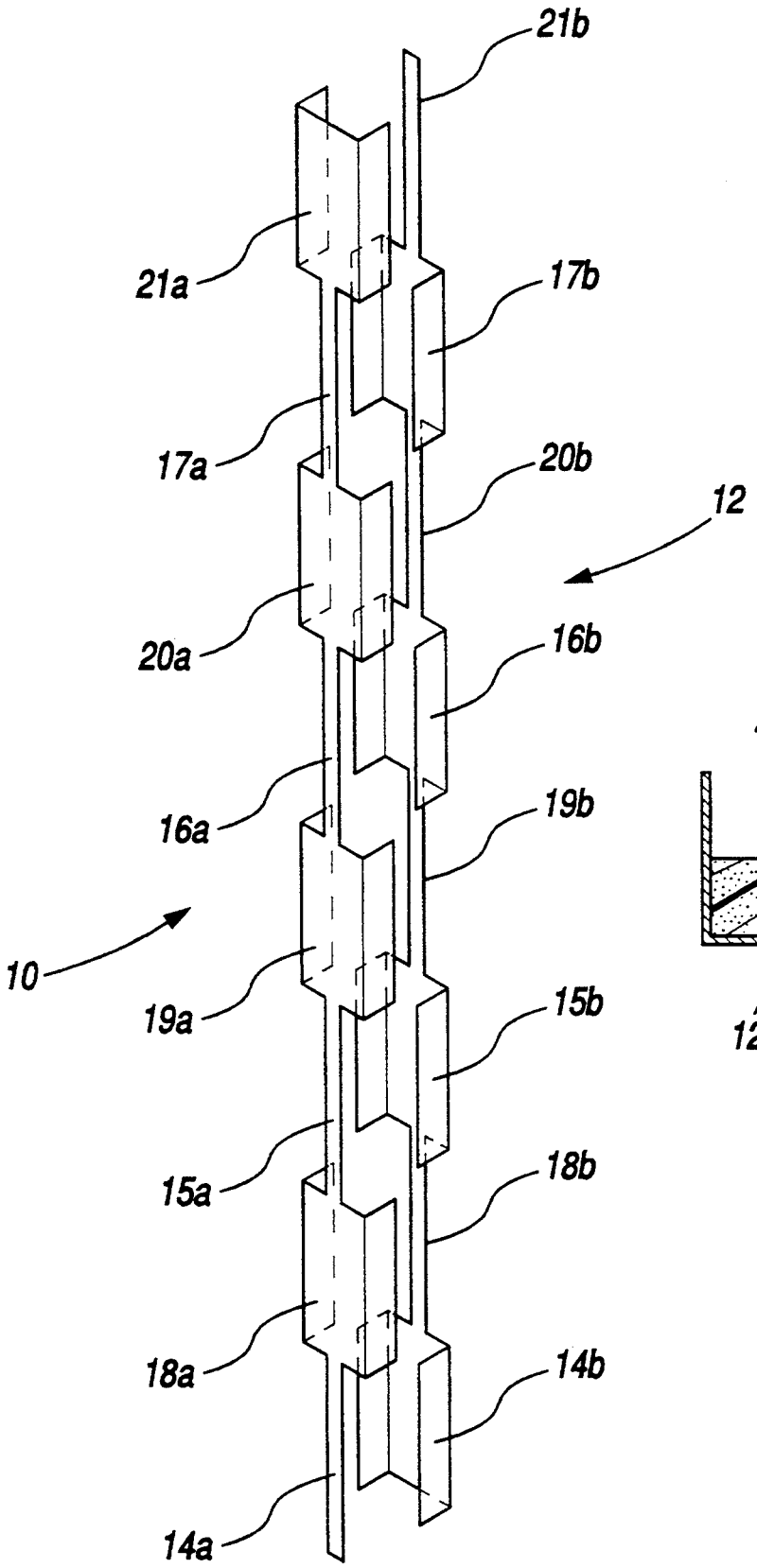
FIG. 1 is a perspective view of a pair of opposing conductive sections, according to the present invention, which may be used to form an improved antenna structure.
Figure 2B:
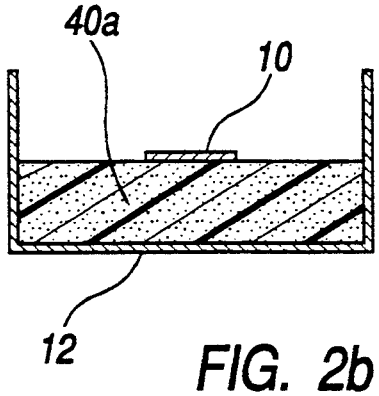
FIG. 2*b* is an enlarged section taken generally along line 2*b*—2*b* in FIG. 2*a;*
Figure 2A:
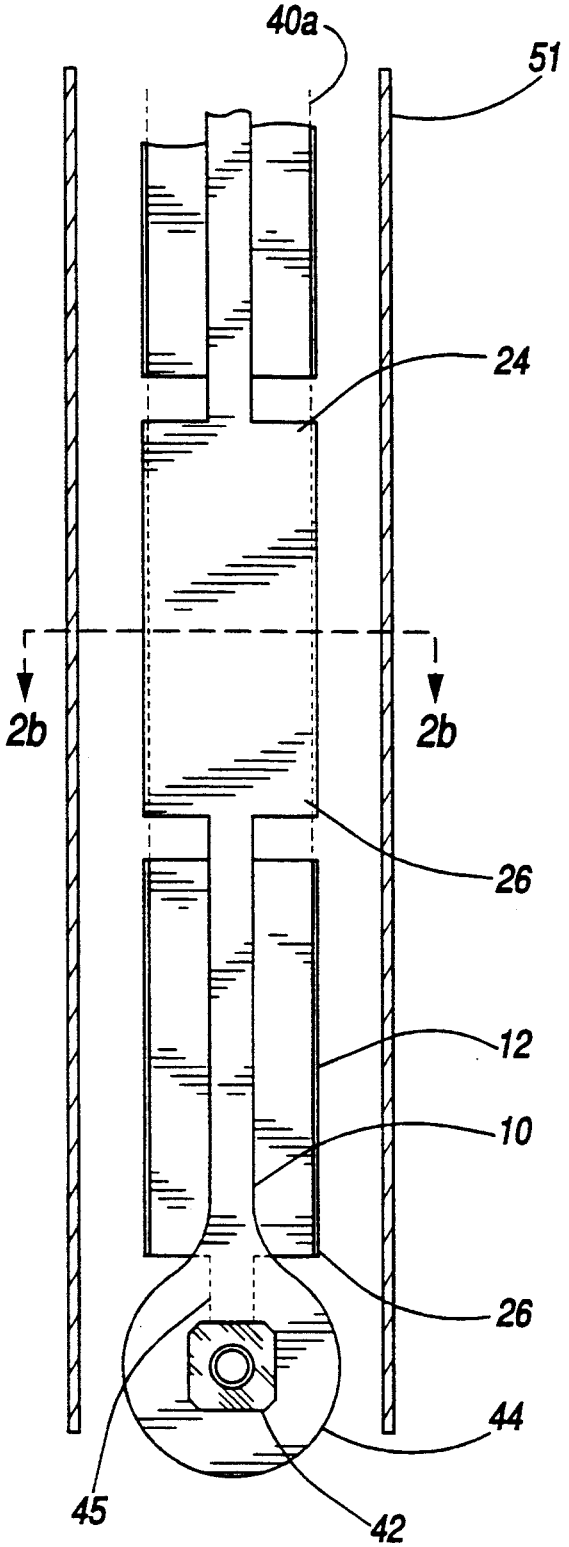
FIG. 2*a* is a rear elevation view of an antenna using the conductive sections of FIG. 1, with one of the sections shown behind the other section and with a coaxial connector shown as an end feed for the antenna structure.
Figure 3A:
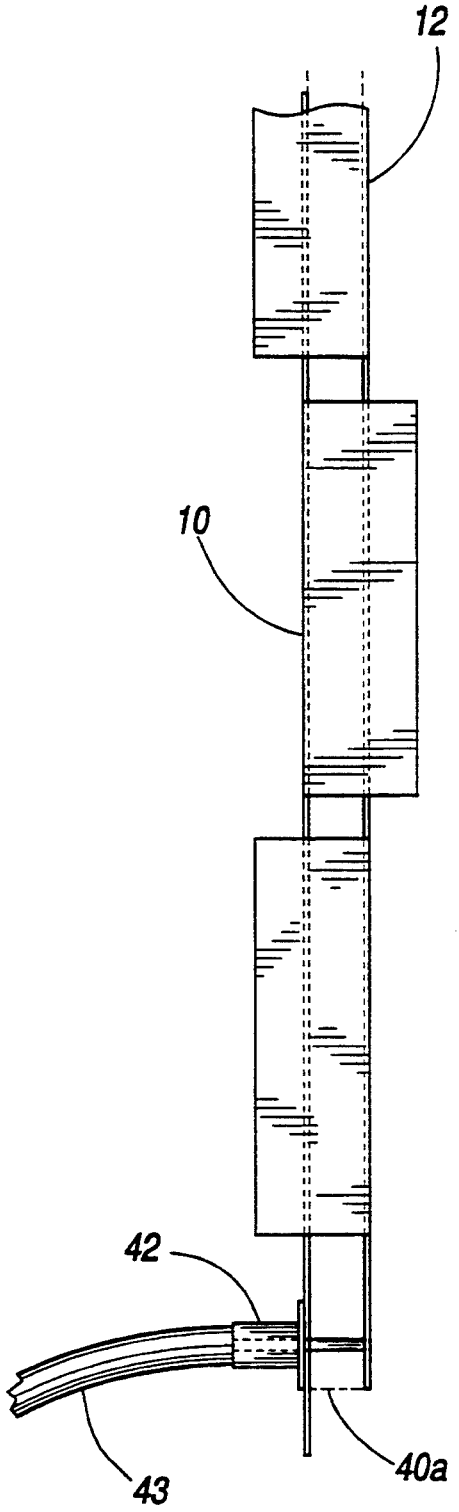
FIG. 3*a* is a side elevation taken from the right-hand of FIG. 2.
Figure 3B:
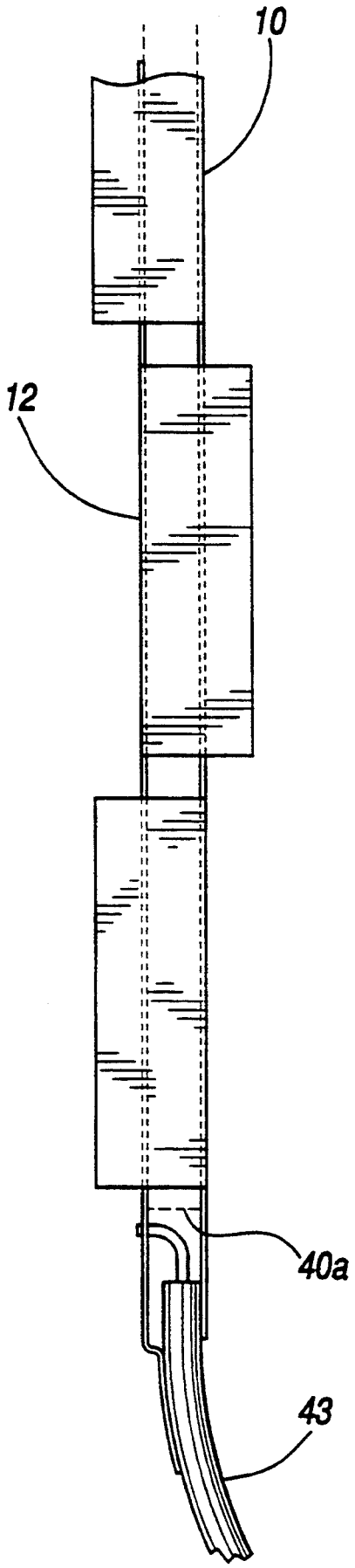
FIG. 3*b* the same view shown in FIG. 3*a* with a modified arrangement for the coaxial feed cable.

While the invention is susceptible to various modifications and alternative forms, specific embodiments thereof have been shown by way of example in the drawings and will be described in detail. It should be understood, however, that it is not intended to limit the invention to the particular form described. On the contrary, the intention is to cover all modifications, equivalents, and alternatives falling within the spirit and scope of the invention as defined by the appended claims.

DETAILED DESCRIPTION OF THE PREFERRED EMBODIMENTS

The present invention is directed to radio frequency antenna applications in which signals are transmitted and/or received in the frequency range of about 100 MHz. to 10,000 (or higher) MHz. Some of the intended uses for the present invention are signal transmission or reception at base stations in cellular telephone systems, personal communication network systems (e.g., operating at 1700–1900 MHz.), microwave distribution systems and multipoint distribution systems.

Turning now to the drawings and referring first to FIG. 1, opposing conductive sections 10 and 12 are illustrated having a substantially uniform gap therebetween. In another embodiment, however, the gap may be non-uniform throughout the trough line depending on the application and the desired pattern response. Each conductive section 10 and 12 includes alternating wide and narrow portions (or elements). The wide portions are bent to form U-shaped troughs. For the first conductive section 10, the narrow elements are designated 14*a*–17*a*, and the trough elements are designated 18*a*–21*a*. Conversely, for the second conductive section 12, the trough elements are designated 14*b*–17*b*, and the narrow elements are designated 18*b*–21*b*. The trough elements for the first conductive section 10 are arranged opposite to and surrounding the narrow elements for the second conductive section 12, and vice-versa, forming a trough line to provide radiation from the outer surfaces of the trough elements 14*b*–17*b*. The inner surfaces of the trough elements 14*b*–17*b* and the narrow elements 18*b*–21*b* act as a transmission line or center conductor for the trough line antenna. The radiation from the sections 10 and 12 has a polarization that is parallel to the length of the structure shown. The desirable radiation is emitted by the outer surface of the trough elements, but the radiation from the narrow segments is undesirable because the narrow segment has a current flow out of phase with the current flow on the trough element. In accordance with one aspect of the invention, the trough line suppresses the undesirable radiation from the narrow elements, thereby significantly improving the array pattern for the antenna. In addition, because the trough line suppresses the undesirable radiation from the narrow segments, the impedance for the trough line radiation elements is easily obtained by changing the width of the narrow segments without affecting the array pattern for the trough line antenna.

Each conductive section 10 or 12 is preferably formed from a thin metallic plate, e.g., a 1/32 inch thick brass plate. The conductive sections are arranged substantially parallel to one another with a gap between them. Once again, the gap between the conductive sections need not be uniform depending on the desired pattern response. The troughs inherently inhibit the build-up of capacitances in the gap between the sections 10 and 12 because the shape of the troughs reduces the proximity of parallel trough edges between two consecutive and opposing trough elements. Additionally, a plastic radome 51 is used to enclose the elongated unit comprising the sections 10 and 12. The trough line antenna fits into a smaller diameter radome than an antenna structure having flat wide elements, thereby reducing the ice and wind load on the radome and making a more compact antenna.

Figure 6:
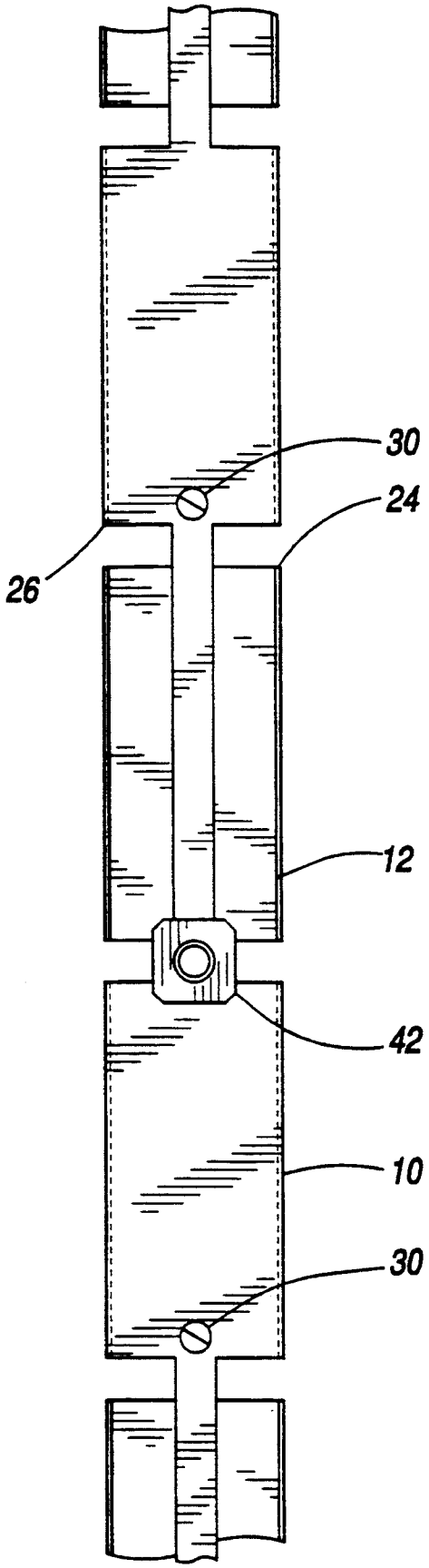
FIG. 6 is a rear elevation of the conductive sections of FIG. 1, with one of the sections shown behind the other section and with a coaxial connector shown as a center feed for the antenna structure, as an alternative to the end feed arrangement of FIG. 2*a;*
Figure 7A:
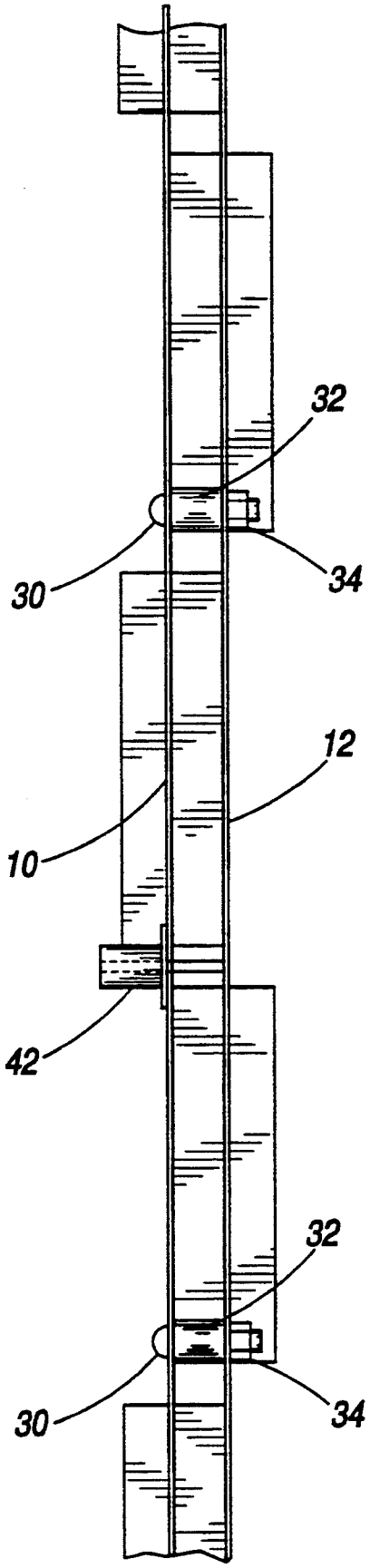
FIG. 7*a* is a side elevation taken from the right-hand side of FIG. 6.
Figure 7B:
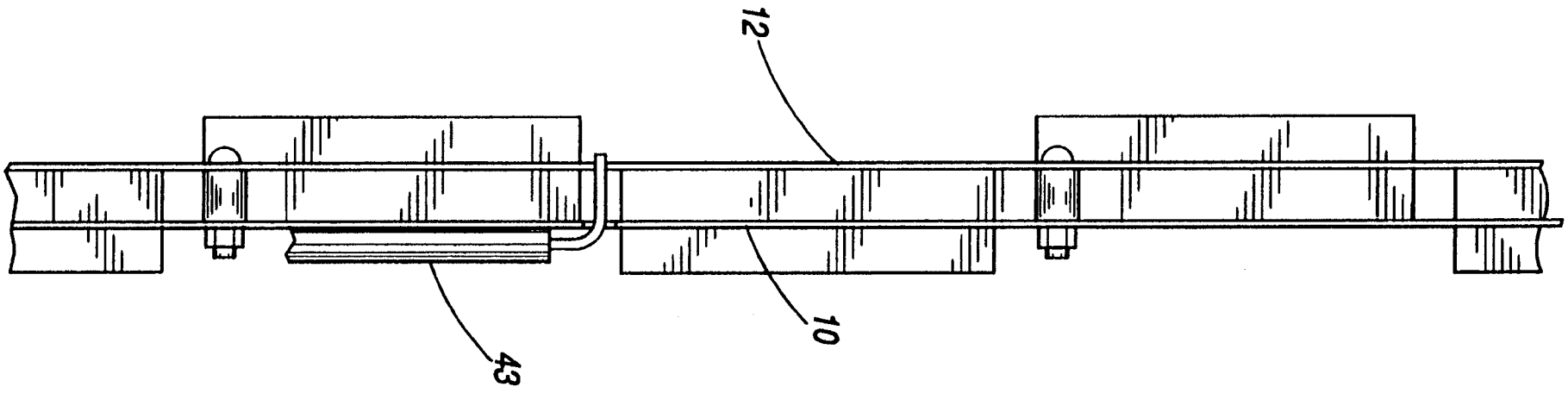
FIG. 7*b* is the same view shown in FIG. 7*a* with a modified arrangement of the coaxial feed cable.

A nonconductive material 40*a*, such as a dielectric foam, may be placed in the gap and adhered to the inside surfaces of the first and second conductive sections 10 and 12 to maintain the gap therebetween. The foam dielectric 40*a* may fill the entire gap or it may be selectively placed in spaced sections of the gap to provide the requisite support. Alternatively, as depicted in FIG. 6, 7*a* and 7*b*, the gap may be maintained between the first and second conductive sections 10 and 12 by nonconductive screws (or bolts) 30, such as nylon screws, with a spacer 32 separating the sections 10 and 12 and a nut 34 securing the spacer 32. Preferably, such screw-spacer-nut assemblies are located at every other pair of opposing elements 14–21.

The characteristic impedance of the trough line may be approximated by viewing each trough and narrow element pair as a trough line structure. Thus, with A as the width of a trough, W the width of the narrow conductor, $E_r$ the relative dielectric constant of the material in the space between the conductors, and h the gap spacing between the trough and narrow element pair, the characteristic impedance of the trough and narrow segment pair is approximately equal to:

$$[138/(\text{square root of } E_r)*\log_{10}(4*A/(pi*W))*\tanh(pi*h/A)].$$

Typically, the impedance of each trough and narrow element pair is the same, but the impedance of these trough and narrow element pairs is not necessarily constant throughout the trough line antenna structure, to produce certain desired effects, such as an amplitude and/or phase taper, it may be desirable to vary the impedance.

A coaxial cable, preferably having a diameter chosen so as not to exceed the width of the narrow element, is preferably electrically coupled to the first and second conductive sections for coupling a radio frequency signal to the antenna of FIG. 1. This coupling may be implemented using end feeding, center feeding or offset feeding. Offset feeding involves coupling the coax to the antenna structure as shown in FIGS. *7a* and *7b*, but the coupling occurs at a selected point along the trough line and not at the center of the trough line as in center feeding. Offset feeding produces certain desired effects, such as beam tilt or certain pattern shapes. Advantageously, such coaxial cable is run along the sections adjacent and inside the radome; thus, the cable may be an integral part of the antenna structure thereby eliminating the difficulties encountered in coaxial collinear antenna arrays where the feeding cable must not be allowed to reradiate RF signals and must be electrically isolated from the radiating elements. The present invention therefore obviates the need for RF chokes and/or similar devices required by the prior art. FIGS. *2a* and *3a*, illustrate an end feeding implementation with a conventional SMA coaxial connector 42 coupling the coaxial cable 43 to the sections 10 and 12. In FIG. *3b* the cable 43 is fed longitudinally between the lower ends of the two sections 10 and 12. The inner conductor is connected to the section 12, and the outer conductor is fastened to both sections 10 and 12, with a quarter wavelength spacing between the connections of the inner and outer conductors to the section 12.

Also illustrated is a tear-drop-shaped extension 44 of the section 10 which may be used as a balanced feeding network to couple energy onto the sections 10 and 12. A narrow portion 45 of the section 12 extends down on the opposite side of the extension 44 so that the inner conductor of the cable 43 may be soldered thereto. Preferably, the outer conductor, via the connector 42, is soldered (or otherwise secured) to the extension 44 in an aperture through the extension 44. Thus, the inner conductor of the cable 43 is exposed in the gap between the sections 10 and 12 and connected to the section 12.

Figure 4:
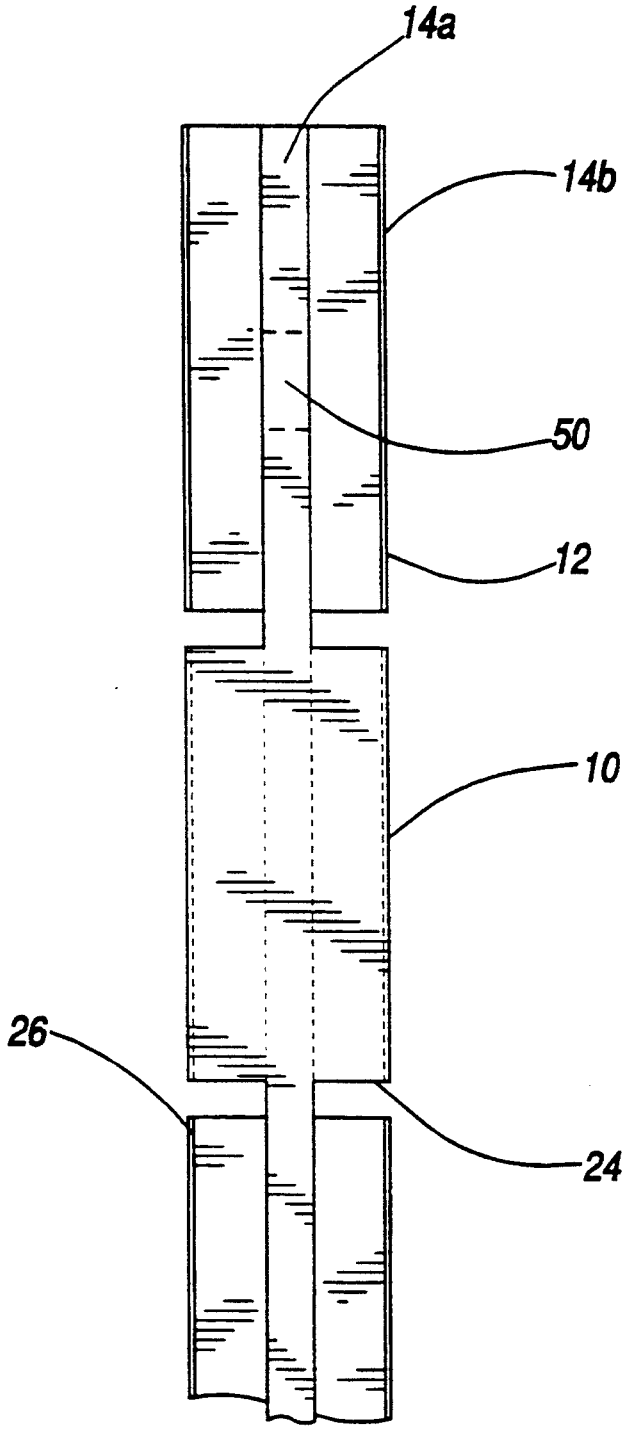
FIG. 4 is a rear elevation of the conductive sections of FIG. 1, with one of the sections shown behind the other section and with a terminating conductive block at one end.
Figure 5:
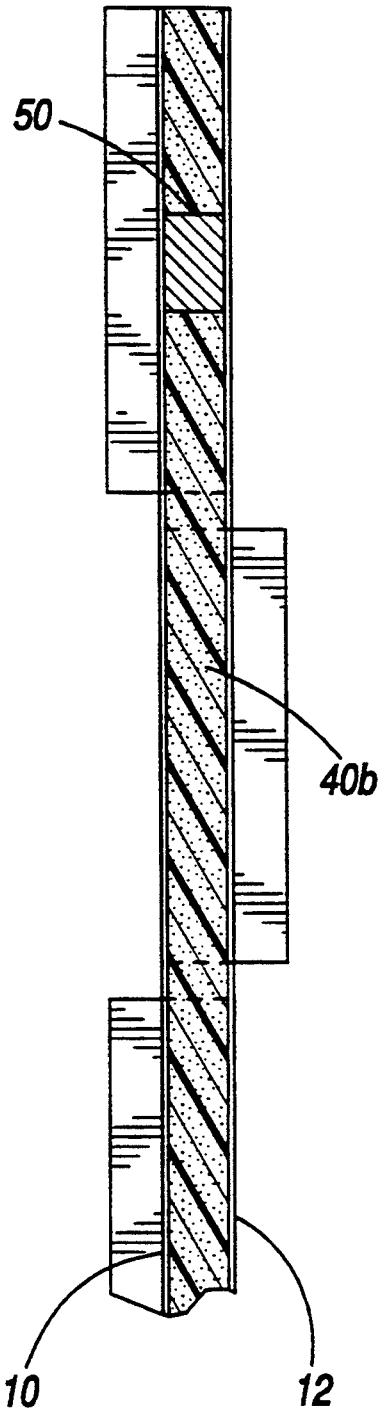
FIG. 5 is a section taken longitudinally through the center of the structure shown in FIG. 4.

The unit comprising sections 10 and 12 may be terminated using a short, an open or a load at the pair of elements at the end opposite the feeding. Preferably, as illustrated in FIGS. 4 and 5, shorting termination is provided using a conductive rod (or block) 50 electrically connected and secured to the sections 10 and 12. The conductive rod 50 should be located at the center of the end pair of elements 14a and 14b. Alternatively, an open termination may be implemented simply by omitting any termination elements. The dielectric spacer 40b in FIGS. 4 and 5 is only as wide as the narrow sections of the radiating elements 10 and 12.

FIGS. 6 and 7 illustrate a center feed arrangement for coupling a radio frequency signal to the antenna of FIG. 1. As in the case of end feeding, a conventional SMA coaxial connector 42 is used to couple the coaxial cable 43 to the sections 10 and 12. In center feeding, however, the coaxial connector 42 is secured to the sections 10 and 12 via an aperture through the section 10 centered at the approximate point at which the middle trough element meets the middle narrow element. FIG. *7b* illustrates another method of center feeding with the coaxial cable 43 running along the trough line to the point where the middle trough element meets the middle narrow element. Offset feeding is accomplished in the same manner as center feeding in FIGS. 6, *7a* and *7b* except that the coupling of the coax 43 to the trough line does not occur at the center of the trough line.

As with the termination for the end feeding structure of FIGS. *2a*, *3a* and *3b*, termination for the center feeding structure of FIGS. 6, *7a* and *7b* as well as for offset feeding may be implemented in essentially the same manner, preferably using a conductive rod 50 electrically connected and secured to the sections 10 and 12, as illustrated in FIGS. 4 and 5. However, this termination is preferably implemented at the centers of the elements at both ends. Additionally, termination can be implemented with an open or load at both ends.

The practical bandwidth of the structures shown in FIGS. 1–*7b* is determined principally by the length of the structure. For maximum gain, the entire structure should be close to resonance. Keeping the antenna gain change within 0.5 dB, the bandwidth for a 6 wavelength long antenna is about 10 percent, and the bandwidth for a 10 wavelength long antenna is about 6 percent.

Figure 8:
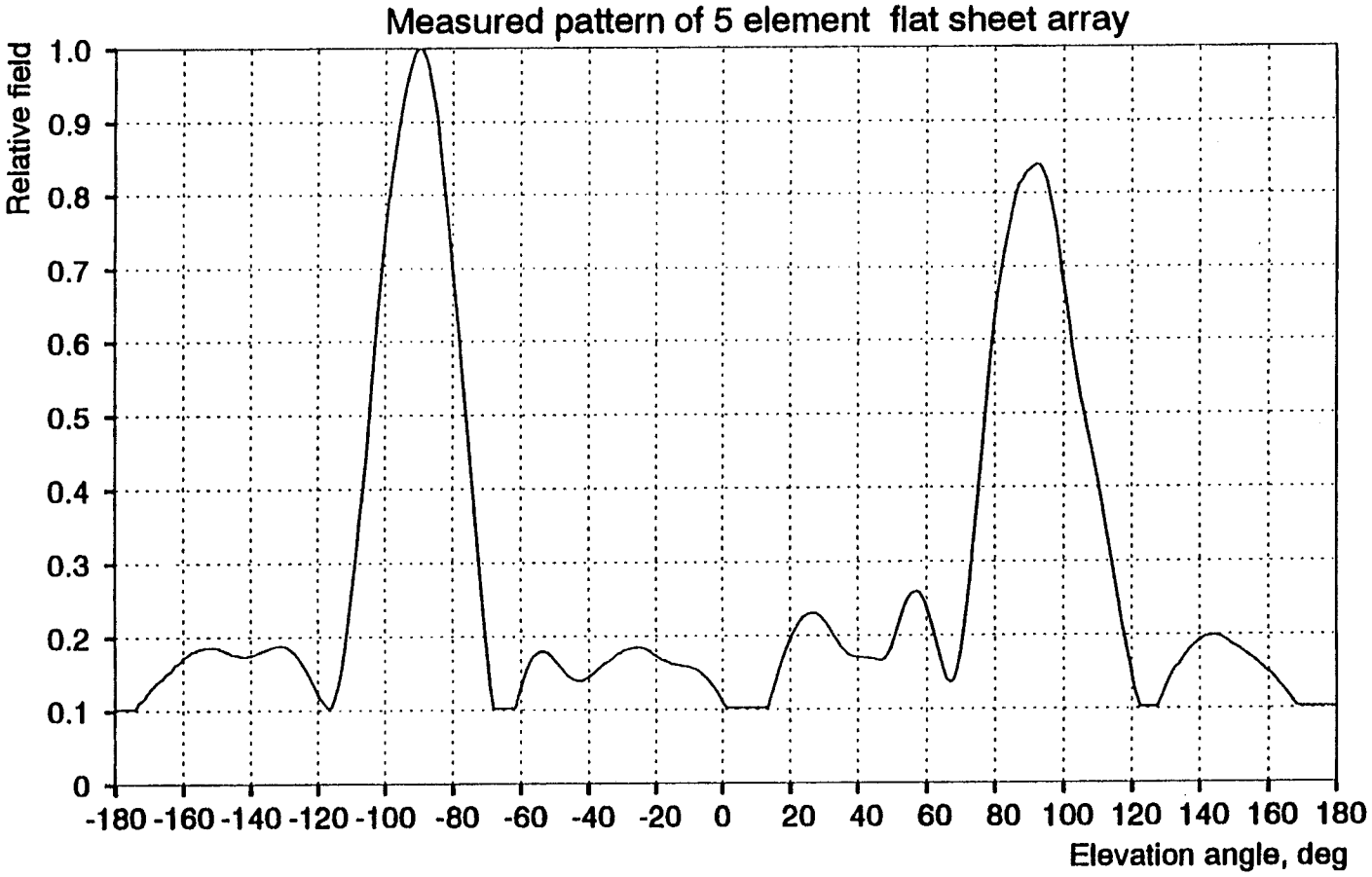
FIG. 8 is a graph of the measured pattern of a flat serrated antenna structure of five elements, according to the antenna structure of patent application Ser. No. 07/618,152.

FIG. 8 shows the measured pattern of a 5 element antenna array employing conductive sections according to the antenna structure of U.S. patent application Ser. No. 07/618,152. The pattern is not symmetrical because one side of the antenna structure has three wide elements and two narrow elements while the other side has two wide elements and three narrow elements. The width of the wide element controls the amount of radiation emitted by the antenna structures and, thus, influences its radiation pattern. Additionally, the width of the wide element affects the impedance of the antenna line, and detrimentally affects the azimuth pattern for the antenna structure. The width of the narrow elements affect the impedance of the antenna line and detrimentally affects the radiation pattern for the antenna structure by radiating undesirable radiation that is out of phase with the radiation emitted by the wide elements. By folding the wide elements into troughs, the deleterious effects of the wide and narrow elements are eliminated. The troughs reduce the cross-section of the antenna structure, thereby improving the azimuth pattern of the antenna. Furthermore, the troughs improve the radiation pattern of the antenna structure because the trough elements suppress the undesirable radiation from the narrow elements. Thus, the trough line antenna structure an improved radiation pattern with an improved azimuth pattern and, in addition, provides easy control over the impedance of the trough line by changing the width of the narrow element without detrimentally affecting the radiation pattern.

Figure 9:
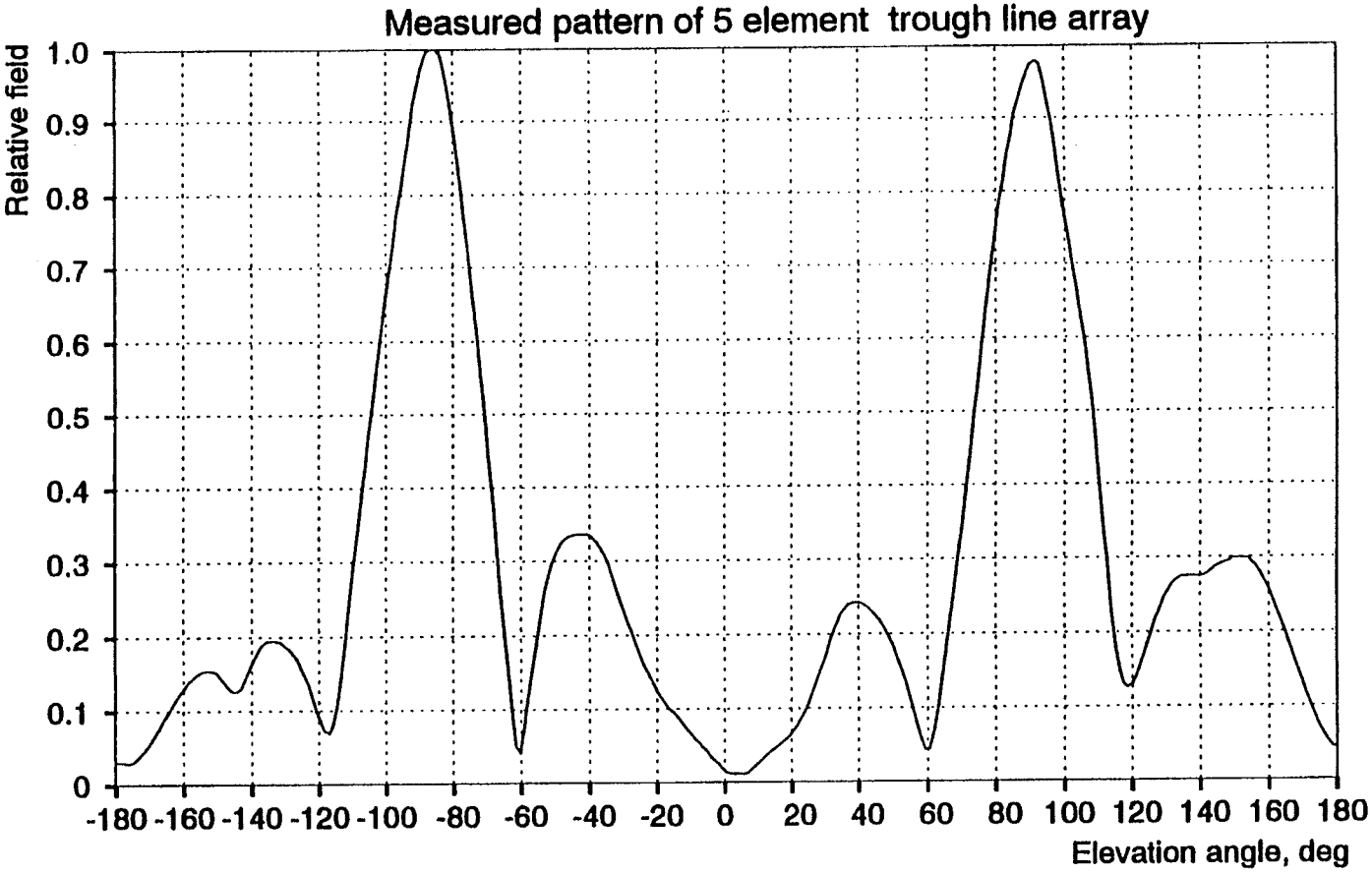
FIG. 9 is a graph of the measured patterns of a trough line antenna structure of five elements, according to the improved antenna structure of the present invention.

Similarly, FIG. 9 shows the measured pattern of a five-element array employing the trough line structure of the present invention. The radiation pattern is more clearly defined as a result of the troughs reducing the undesirable radiation from the narrow segments. Furthermore, the azimuth pattern of the trough line antenna becomes more omnidirectional because the azimuth aperture or cross-section of the antenna is reduced by the folding of the wide elements to form troughs.

Accordingly, the present invention provides a cost-effective, compact and accurate antenna structure for RF communication. While the inventive antenna structure has been particularly shown and described with reference to certain embodiments, it will be recognized by those skilled in the art that modifications and changes may be made to the present invention without departing from the spirit and scope thereof.

I claim:

1. A radio frequency antenna, comprising:

a first conductive section having alternating wide trough and narrow flat portions;

an opposing second conductive section having alternating wide trough and narrow flat portions which are arranged opposite the narrow and wide portions, respectively, of the first conductive section such that each of said wide trough portions of said first conductive section partially surrounds said narrow flat portion of said second conductive section and each of said wide trough portions of said second conductive section partially surrounds said narrow flat portion of said first conductive section;

wherein a gap is formed between the first and second conductive sections such that the first and second conductive sections form, at least in part, an elongated unit having a first end and a second end; and coupling means, electrically coupled to the first and second conductive sections, for coupling a radio frequency signal to the antenna.

2. A radio frequency antenna, according to claim 1, further including termination means for terminating at least one of the ends of the unit.

3. A radio frequency antenna, according to claim 2, wherein the termination means includes a conductor, connected between the first and second conductive sections.

4. A radio frequency antenna, according to claim 2, wherein the termination means includes means for providing an open for communication signals between the first and second conductive sections.

5. A radio frequency antenna, according to claim 2, wherein the termination means includes a load, connected between the first and second conductive sections.

6. A radio frequency antenna, according to claim 1, wherein the coupling means includes a coaxial cable which has an outer conductor that is electrically coupled to the first conductive section and includes an inner conductor that is electrically coupled to the second conductive section.

7. A radio frequency antenna, according to claim 6, wherein the outer conductor is electrically coupled to the first conductive section at a selected point of the elongated unit and the inner conductor is electrically coupled to the second conductive section opposite the first conductive section also at the selected point of the elongated unit.

8. A radio frequency antenna, according to claim 6, further including a coaxial connector for coupling the coaxial cable to the respective first and second conductive sections.

9. A radio frequency antenna, according to claim 6, wherein the outer conductor is electrically coupled to the first conductive section at the first end of the elongated unit and the inner conductor is electrically coupled to the second conductive section opposite the first conductive section also at the first end of the elongated unit, and further including termination means at the second end of the unit.

10. A radio frequency antenna, according to claim 9, wherein the termination means includes a conductor, connected between the first and second conductive sections.

11. A radio frequency antenna, according to claim 9, wherein the termination means includes means for providing an open for communication signals between the first and second conductive sections.

12. A radio frequency antenna, according to claim 9, wherein the termination means includes a load, connected between the first and second conductive sections.

13. A radio frequency antenna, according to claim 1, further including means, within the gap, for supporting the first and second conductive sections so as to maintain the gap and wherein the first and second conductive sections are shaped and arranged so as to lessen capacitance therebetween.

14. A radio frequency antenna, comprising:

a first conductive section having alternating trough and narrow portions;

an opposing second conductive section having alternating wide trough and narrow flat portions which are arranged opposite the narrow and wide portions, respectively, of the first conductive section such that each of said wide trough portions of said first conductive section partially surrounds said narrow flat portion of said second conductive section and each of said wide trough portions of said second conductive section partially surrounds said narrow flat portion of said first conductive section;

means for securing the first and second conductive sections together with a gap formed therebetween such that the first and second conductive sections form an elongated unit having a first end and a second end;

a termination conductor means at opposing portions of the first end of the unit;

coupling means, electrically coupled to the first and second conductive sections at the second end of the unit, for coupling a radio frequency signal to the antenna;

wherein each portion of the first and second conductive sections has a typical length which is not greater than about one-half wavelength of the coupled radio frequency signal; and a radome substantially enclosing the unit.

15. A radio frequency antenna, according to claim 14, wherein the first and second conductive sections are arranged substantially parallel to one another.

16. A radio frequency antenna, according to claim 14, wherein the first and second conductive sections are shaped and arranged so as to lessen capacitance therebetween.

17. A radio frequency antenna, comprising:

a first conductive section having alternating wide trough and narrow flat portions;

an opposing second conductive section having alternating wide trough and narrow flat portions which are arranged opposite the narrow and wide portions, respectively, of the first conductive section such that each of said wide trough portions of said first conductive section partially surrounds said narrow flat portion of said second conducting member and each of said wide trough portions of said second conducting member partially surrounds said narrow flat portion of said first conductive section;

means for securing the first and second conductive sections together with a gap formed therebetween such that the first and second conductive sections form an elongated unit having a first end and a second end;

first and second termination conductors respectively at the first and second ends of the unit;

coupling means, electrically coupled to the first and second conductive sections at a selected point of the elongated unit, for coupling a radio frequency signal to the antenna so as to provide polarization in a direction that is parallel to the direction of the elongation;

wherein each portion of the first and second conductive sections has a length which is not greater than one-half wavelength of the coupled radio frequency signal; and a radome substantially enclosing the unit.

18. A radio frequency antenna, according to claim 17, wherein said means for securing the first and second conductive sections includes nonconductive screws.

19. A radio frequency antenna, according to claim 18, wherein said means for securing the first and second conductive sections includes insulating material having opposing sides respectively adhered to the first and second conductive sections.

20. A radio frequency antenna, according to claim 17, wherein the first and second conductive sections are shaped and arranged so as to lessen capacitance therebetween.

21. A radio frequency antenna, according to claim 20, wherein all the wide trough portions are approximately the same size and shape.

22. A method for manufacturing a radio frequency antenna, comprising the steps of:

forming a first conductive section having alternating trough and narrow portions and an opposing second conductive section having alternating trough and narrow portions such that the sections have substantially that same shape;

arranging said troughs and said narrow portions of said second conductive section opposite said narrow portions and said troughs, respectively, of said first conductive section such that each of said troughs of said first conductive section partially surrounds said narrow portion of said second conductive section and each of said troughs of said second conductive section partially surrounds said narrow portion of said first conductive section;

securing the first and second conductive sections with a gap therebetween such that the first and second conductive sections define, at least in part, an elongated unit having a first end and a second end; and electrically coupling a connector to the first and second conductive sections for coupling a radio frequency signal to the antenna.

* * * * *